United States Patent [19]

Spitters et al.

[11] Patent Number: 4,739,213

[45] Date of Patent: Apr. 19, 1988

[54] ELECTRON TUBE WITH SUPPORT FOR PYROLYTIC GRAPHITE ELECTRODE

[76] Inventors: Antonius M. M. Spitters; Henricus A. J. M. Knols, both of Jan Campertstraat 5, Heerlen, Netherlands

[21] Appl. No.: 816,184

[22] Filed: Jan. 6, 1986

[30] Foreign Application Priority Data

Jan. 28, 1985 [NL] Netherlands ..... 8500220

[51] Int. Cl.[4] ..... H01J 1/46; H01J 1/94

[52] U.S. Cl. ..... 313/348; 313/341; 313/343; 313/349; 313/356

[58] Field of Search ..... 313/348, 356, 346, 349, 313/352, 341, 343, 296, 299

[56] References Cited

U.S. PATENT DOCUMENTS

| | | | |
|---|---|---|---|
| 3,800,378 | 4/1974 | Lee et al. | 29/25.18 |
| 3,943,398 | 3/1976 | Gerlach | 313/341 |
| 4,119,880 | 10/1978 | Wilcox et al. | 313/348 |
| 4,229,674 | 10/1980 | Hoët | 313/348 |

FOREIGN PATENT DOCUMENTS

| | | | |
|---|---|---|---|
| 7829922 | 5/1980 | France | 313/346 |
| 1011587 | 12/1965 | United Kingdom | 313/346 |
| 1514591 | 6/1978 | United Kingdom | 313/346 |

*Primary Examiner*—Leo H. Boudreau
*Assistant Examiner*—Mark R. Powell
*Attorney, Agent, or Firm*—Robert J. Kraus

[57] ABSTRACT

In an electron tube comprising a pyrolytic graphite electrode which is a hollow body of revolution and which has an open end at which it is secured to a substantially coaxially cylindrical electrode support, a substanially cylindrical sleeve of a carbide-forming metal is interposed radially between the end of the pyrolytic graphite electrode and the electrode support. One end of the sleeve is fused around the end of the electrode and the other end is secured to the grid support. Thus, the pyrolytic graphite electrode is secured in an uncomplicated and efficient way with a satisfactory dielectric strength and without affecting the electric field of the tube in operation.

5 Claims, 1 Drawing Sheet

ELECTRON TUBE WITH SUPPORT FOR PYROLYTIC GRAPHITE ELECTRODE

BACKGROUND OF THE INVENTION

The invention relates to an electron tube comprising an electrode of pyrolytic graphite, which is a hollow body of revolution and which has an open end at which it is secured to a cylindrical electrode support.

Electrodes of pyrolytic graphite have been used in transmitting tubes for a long time.

Such an electron tube is known from, for example, U.S. Pat. No. 4,229,674, in which the grid electrode of pyrolytic graphite is secured to the electrode support by means of a number of screws which are spaced equidistantly around the grid. In order to ensure proper electrical contact between these parts a large number of screws is necessary. In a transmitting tube, the screws are often located in a region of high fieldstrength so that additional steps are necessary to preclude disturbance of the electric field.

British Patent Specification No. GB 1,514,591 describes how this problem is solved by means of two conical auxiliary rings which are secured to each other by means of screws, soldering or welding and between which the grid electrode of pyrolytic graphite is clamped. However, this is relatively complicated and time-consuming to manufacture and it cannot readily be used in existing types of tubes.

German Patent Specification 11 94 988 corresponding to British Patent Specification No. 1,011,587, describes a grid electrode of pyrolytic graphite which is secured to an auxiliary ring of pure graphite by means of titanium carbide, zirconium carbide or pure titanium. A disadvantage of this method is that it employs ordinary graphite which may adversely affect the dielectric strength of the tube.

French Patent Application No. 2,439,474, which is open to public inspection, discloses a grid electrode of pyrolytic graphite, which is cast in a trough-shaped element of metal (e.g. molybdenum, tungsten or an alloy of iron-nickel and cobalt) or of graphite by means of a soldering material (e.g. copper, gold or a copper-silver alloy). A disadvantage of this method is that a high grid load causes the soldering material to become so hot that it evaporates.

European Patent Specification No. 0,010,128 B discloses a cathode having a body of pyrolytic graphite, which is covered with a layer of an emitting material. When securing this cathode the same problems occur as with the grids described above.

SUMMARY OF THE INVENTION

It is an object of the invention to provide an electron tube in which an electrode of pyrolytic graphite is secured so that the above-described disadvantages are mitigated.

According to the invention, an electron tube of the type described in the opening paragraph is characterized in that a substantially cylindrical sleeve of a carbide-forming metal is interposed radially between the end of the electrode of pyrolytic graphite and the electrode support, one end of the sleeve being fused around the end of the electrode and the other end of the sleeve being secured to the electrode support.

By means of the invention, a relatively uncomplicated and readily made fastening of the electrode of pyrolytic graphite is obtained, which has a high dielectric strength and does not disturb the electric field of the tube in operation. The hollow body of revolution generally has the shape of a hollow cylinder or cone. The cylindrical sleeve can be made of any metal provided that it is a good carbide-forming agent. For use in high-power electron tubes, however, the choice will in practice generally be limited to molybdenum, tungsten and tantalum, owing to the fact that a high melting point is required. The material of the sleeve can be melted by means of arc welding, for example, argon or helium arc-welding. However, plasma welding may alternatively be used.

The substantially cylindrical sleeve can be connected to the electrode support by means of welding, soldering or screws.

In order to preclude the formation of cracks in the electrode of pyrolytic graphite, slots extending away from the sleeves may be formed in the end of the grid near the sleeve, in a manner analogous to that described in U.S. Pat. No. 4,229,674.

BRIEF DESCRIPTION OF THE DRAWINGS

By way of example, embodiments of the invention will now be explained in greater detail with reference to the drawing figures, in which.

DESCRIPTION OF THE PREFERRED EMBODIMENT

Figure 1:
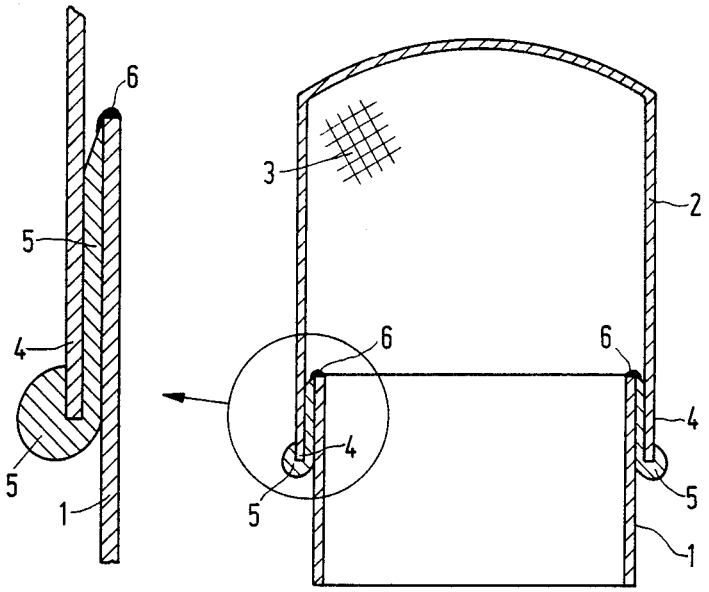
FIG. 1 is a longitudinal sectional view of a grid of pyrolytic graphite secured to an electrode support.

FIG. 1 is a diagrammatic longitudinal sectional view of a grid 2 of pyrolytic graphite which is secured to an electrode support 1 of molybdenum. Grid 2 and electrode support 1 each have the shape of a hollow cylinder with a circular section. Grid openings 3 are indicated only schematically in the Figure. A substantially cylindrical sleeve 5 of molybdenum, one end of which is fused around one end 4 of the grid 2 is interposed radially between end 4 of grid 2 and electrode support 1. The other end 6 of sleeve 5 is welded to the electrode support.

Figure 2:
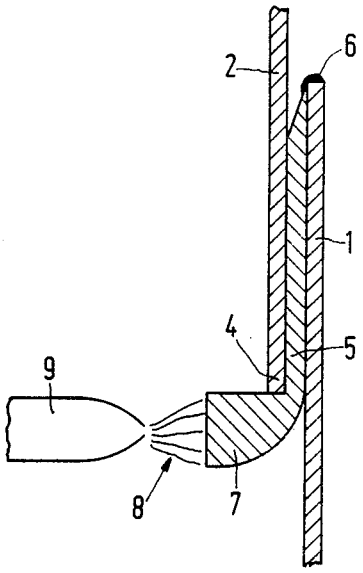
FIG. 2 shows how the cylindrical sleeve is fused around the end of a grid of pyrolytic graphite.

FIG. 2 shows how one end of sleeve 5 is fused around end 4 of the grid 2 of pyrolytic graphite. Sleeve 5 has a thickened portion 7 at one end, which portion is heated by means of an arc 8. The arc is drawn between part 7 and a welding rod 9. As soon as part 7 starts to melt, it will flow around end 4 of grid 2 of pyrolytic graphite. Thus, the grid of pyrolytic graphite is secured in such a manner that the dielectric strength is satisfactory and that in operation the electric field in the tube is not adversely affected.

Figure 3:
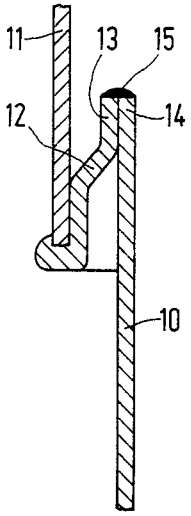
FIG. 3 is a longitudinal sectional view of part of a grid of pyrolytic graphite which is secured to an electrode support by a differently shaped sleeve.

FIG. 3 is a longitudinal sectional view of part of a grid 11 of pyrolytic graphite which is secured to an electrode support 10 by a sleeve 12 of a stepped shape. Sleeve 12 is secured to the grid support by means of solder 15. In this particular case, however, it is also possible to secure portion 13 of sleeve 12 to part 14 of the grid support by means of screwing or welding.

Herein, the invention has been illustrated by describing how a grid electrode is secured. The invention can of course also be used for securing other electrodes, such as a cathode which comprises pyrolytic graphite as shown in European Patent Specification No. 0,010,128 B.

What is claimed is:

1. An electron tube comprising an electrode of pyrolytic graphite, which is a hollow body of revolution and which has an open end at which it is secured substantially coaxially to a cylindrical electrode support, characterized in that a substantially, cylindrical sleeve of a carbide-forming metal is interposed radially between said end of the electrode of pyrolytic graphite and the electrode support, one end of the sleeve extending around and being fused to the end of the electrode, and the other end of the sleeve being secured to the electrode support.

2. An electron tube as claimed in claim 1, characterized in that the sleeve consists essentially of molybdenum, tungsten or tantalum.

3. An electron tube as claimed in claim 1 or 2, characterized in that the electron tube is a transmitting tube.

4. An electron tube as claimed in claim 1 or 2 where said fused end of the sleeve is arc welded around the end of the electrode.

5. An electron tube as claimed in claim 1 or 2 where said fused end of the sleeve is plasma welded around the end of the electrode.

* * * * *